US006211453B1

(12) United States Patent
Kurakake

(10) Patent No.: US 6,211,453 B1
(45) Date of Patent: Apr. 3, 2001

(54) PERFORMANCE INFORMATION MAKING DEVICE AND METHOD BASED ON RANDOM SELECTION OF ACCOMPANIMENT PATTERNS

(75) Inventor: Yasushi Kurakake, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 08/948,307

(22) Filed: Oct. 9, 1997

(30) Foreign Application Priority Data

Oct. 18, 1996 (JP) ..... 8-276461

(51) Int. Cl.[7] ..... G10H 1/26; G10H 1/36
(52) U.S. Cl. ..... 84/609; 84/610; 84/477 R
(58) Field of Search ..... 84/609–614, 634–638, 84/477 R

(56) References Cited

U.S. PATENT DOCUMENTS 4,539,882 * 9/1985 Yuzawa ..... 84/610
4,708,046 * 11/1987 Kozuki ..... 84/610
5,406,024 4/1995 Shioda .
5,510,572 * 4/1996 Hayashi et al. ..... 84/609
5,623,112 * 4/1997 Ito et al. ..... 84/610 X
5,679,913 * 10/1997 Bruti et al. ..... 84/609
5,698,804 * 12/1997 Mizuno ..... 84/610
5,712,436 * 1/1998 Sakama et al. ..... 84/610

FOREIGN PATENT DOCUMENTS 07104744 4/1995 (JP) .

* cited by examiner

*Primary Examiner*—Stanley J. Witkowski
(74) *Attorney, Agent, or Firm*—Rossi & Associates

(57) ABSTRACT

In a memory, there are prestored melody information of a given music piece and other information representative of a plurality of accompaniment patterns suitable for the music piece. For every predetermined performance section (composed of, for example, two measures) of the music piece, a particular accompaniment pattern is randomly selected from among the prestored accompaniment patterns suitable for the music piece. Accompaniment performance information for the music piece is provided by combining the accompaniment patterns randomly selected for the individual performance sections.

12 Claims, 10 Drawing Sheets

| MEASURE | CLIP SEQUENCE DATA |
|---|---|
| 1 — 2 | SEQUENCE 1 |
| 3 — 4 | SEQUENCE 2 |
| 5 — 6 | SEQUENCE 3 |
| 7 — 8 | SEQUENCE 4 |
| 9 — 10 | SEQUENCE 5 |
| 11 — 12 | SEQUENCE 6 |
| 13 — 14 | SEQUENCE 7 |
| 15 — 16 | SEQUENCE 8 |

CLIP PART NO.

PERFORMANCE INFORMATION MAKING DEVICE AND METHOD BASED ON RANDOM SELECTION OF ACCOMPANIMENT PATTERNS

BACKGROUND OF THE INVENTION

The present invention relates to a performance information making device and method which are capable of easily creating various variations of accompaniment patterns well suitable for a music piece melody and thereby allow even unexperienced users or beginners to fully enjoy composing a music piece.

There has been known a technique which, in making music piece data (performance information) by combining automatic performance patterns on an automatic performance device or the like, greatly facilitates editing and modification of the music piece data. Such a technique is disclosed in, for example, Japanese patent Laid-open Publication No. HEI-7-104744 that corresponds to U.S. patent application Ser. No. 08/312,776. The technique disclosed in the HEI-7-104744 publication is characterized primarily by visually displaying a plurality of display elements (e.g., icons) corresponding to a plurality of performance patterns as well as lines specifying order of the performance patterns to be played. The disclosed technique allows a user to designate a desired combination of the visually displayed performance patterns and thereby facilitates user's editing of music piece data.

The performance information making technique disclosed in the HEI-7-104744 publication has the advantage that it provides for easier editing operations to, for example, change the order of the performance patterns. However, the editing requires considerable musical knowledges, which would limit the application of the disclosed technique to relatively experienced users. Therefore, with the disclosed technique, it was difficult for inexperienced users to enjoy composing a music piece.

Further, U.S. Pat. No. 5,406,024 discloses a technique which uses a bar code scanner to select performance patterns in correspondence with time-varying phases of a performance.

SUMMARY OF THE INVENTION

It is therefore an object of the present invention to provide a performance information making device and method which are capable of generating various variations of accompaniment patterns well suitable for a a music piece melody and thereby allow even unexperienced users or beginners to fully enjoy composing a music piece.

In order to accomplish the above-mentioned object, the present invention provides a performance information making device which comprises: a storage device having prestored therein information representative of a plurality of accompaniment patterns suitable for a given music piece; and a pattern selecting device that, for each of predetermined performance sections of the given music piece, randomly selects a particular accompaniment pattern from among the plurality of accompaniment patterns suitable for the given music piece, so that accompaniment performance information for the given music piece is provided by combining the accompaniment patterns randomly selected for individual ones of the performance sections.

In the performance information making device, the storage device may also has prestored therein melody information of the given music piece, and there may be further provided a reproducing device that reproductively performs a melody and accompaniment of the given music piece on the basis of the melody information prestored in the storage device and accompaniment performance information comprising a combination of the accompaniment patterns selected by the pattern selecting device.

According to another aspect of the present invention, there is provided a performance information making method which comprises the steps of: prestoring information representative of a plurality of accompaniment patterns suitable for a given music piece; and for each of predetermined performance sections of the given music piece, randomly selecting a particular accompaniment pattern from among the plurality of accompaniment patterns suitable for the given music piece, so that accompaniment performance information for the music piece is provided by combining the accompaniment patterns randomly selected for individual ones of the performance sections.

The performance information making method may further comprise the steps of: prestoring melody information of the given music piece; and reproductively performing a melody and accompaniment of the given music piece on the basis of the prestored melody information and accompaniment performance information comprising a combination of the accompaniment patterns selected for the individual performance sections.

According to still another aspect of the present invention, there is provided a machine-readable recording medium containing a control program executable by a computer. The control program comprises: a program code mechanism that, for each of predetermined performance sections of a given music piece, randomly selects a particular accompaniment pattern from among a plurality of accompaniment patterns provided in advance and suitable for the given music piece; and a program code mechanism that generates a series of pieces of accompaniment performance information for the given music piece by combining the accompaniment patterns selected for individual ones of the performance sections.

According to yet another aspect of the present invention, there is provided a machine-readable recording medium containing, in a data storage area thereof, data representative of a melody of a given music piece and a plurality of accompaniment patterns suitable for the given music piece and also containing, in a program storage area thereof, a control program executable by a computer. The control program comprises: a program code mechanism that, for each of predetermined performance sections of the given music piece, randomly selects a particular accompaniment pattern from among a plurality of accompaniment patterns provided in advance and suitable for the given music piece; a program code mechanism that reads out, from the data storage area, the data representative of the accompaniment pattern randomly selected for each of the performance sections; and a program code mechanism that reads out the data representative of the melody from the data storage area; and a program code mechanism that reproductively performs the melody and accompaniment of the given music piece on the basis of the read-out data representative of the melody and accompaniment pattern.

According to the essential feature of the present invention, accompaniment patterns corresponding to a plurality of melody performance sections (each having two measures) of a music piece are randomly selected from among a plurality of predetermined accompaniment patterns suitable for the music piece, and the randomly selected accompaniment patterns are arranged in predetermined order (e.g., the order of the performance sections) to provide performance information, which is reproduced along with the melody.

Because the randomly-selected accompaniment patterns correspond to the patterns prestored as suitable for the melody, the reproduced accompaniment information can become suitable for the melody even where the specific nature of the melody and accompaniment patterns are not taken into consideration. Besides, such a random selection easily provides various variations of accompaniment patterns. The accompaniment patterns may be reproduced after being converted in tone pitch on the basis of a chord progression accompanying the melody. Such a tone pitch conversion permits shared use of a general-purpose accompaniment pattern of a predetermined key such as C major.

BRIEF DESCRIPTION OF THE DRAWINGS

For better understanding of the above and other features of the present invention, the preferred embodiments of the invention will be described in greater detail below with reference to the accompanying drawings, in which.

DETAILED DESCRIPTION OF THE PREFERRED EMBODIMENTS

Figure 1:
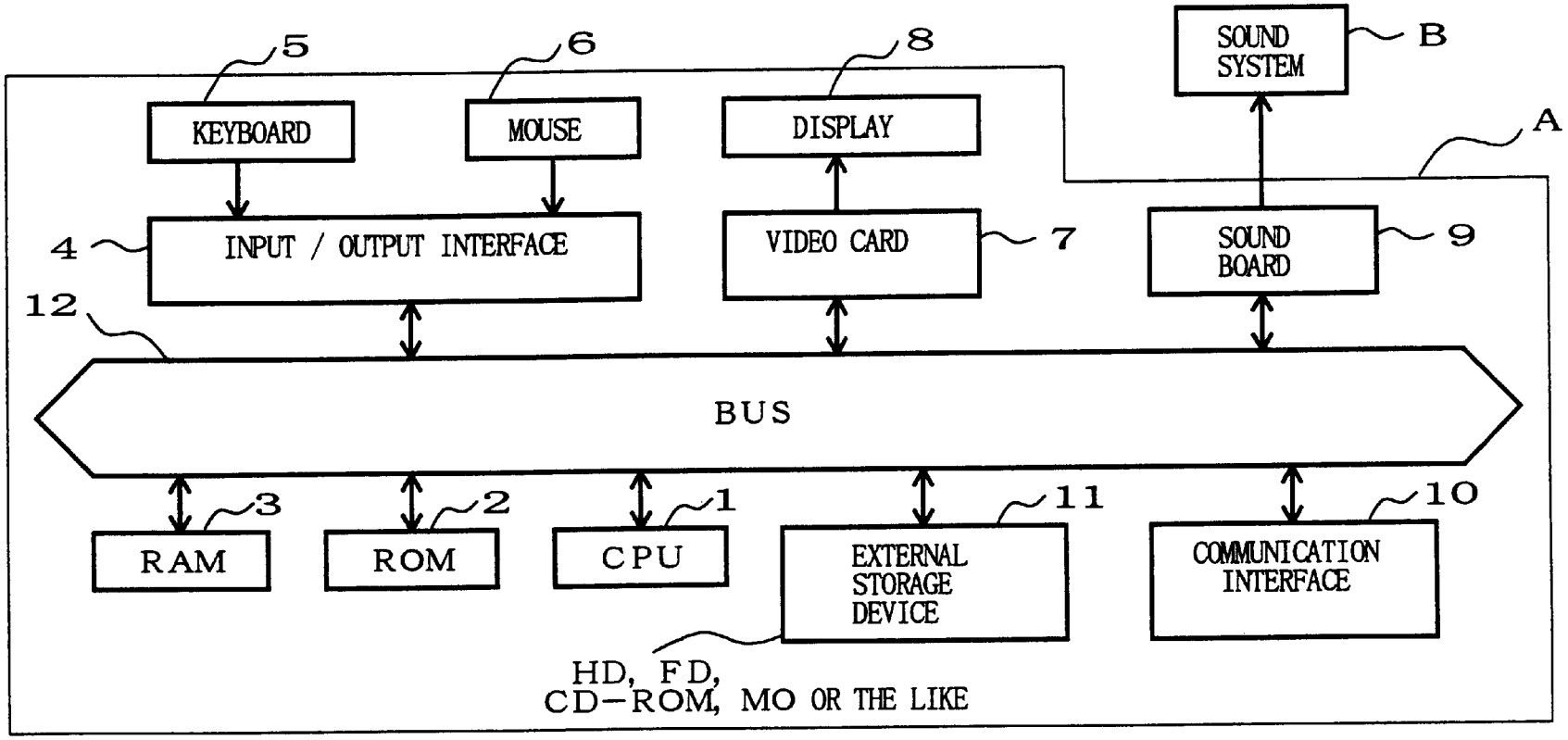
FIG. 1 is a block diagram of a performance information making device according to a first embodiment of the present invention.

FIG. 1 is a block diagram of a performance information making device according to a first preferred embodiment of the present invention, which generally comprises a personal computer and software executable by the personal computer. The personal computer A includes a CPU 1, a ROM 2, a RAM 3, an input/output interface 4, a keyboard 5, a mouse 6, a video card 7, a display device 8, a sound board 9, a communication interface 10, an external storage device 11 and an address and data bus 12.

The CPU 1 performs overall control of the performance information making device, using working areas of the RAM 3 under the control of an OS (Operating System) installed in a hard disk (HD) of the external storage device 11. Specifically, the CPU 1 allows various data, corresponding to user's operation of the keyboard 5 and the mouse 6, to be entered via the input/output interface 4. Thus, the CPU 1 controls the position of a mouse pointer (cursor) on the display device 8 and detects user's clicking operation on the mouse 6. The CPU 1 can also control the visual presentation on the display device 8 via the video card 7. The sound board 9 constitutes a tone source or tone generator device, which generates tone signals corresponding to data (e.g., performance information) entered under the control of the CPU 1. The generated tone signals are audibly reproduced or sounded through a sound system B as well known in the art.

Further, the CPU 1 communicates various data with the hard disk (HD), floppy disk (FD), CD (Compact Disk)-ROM, magneto-optical disk (MO) or the like provided in the external storage device 11, and the CPU 1 also communicates various data with an external MIDI instrument or external computer. In the ROM 2, there are prestored basic programs, such as a BIOS (Basic Input Output System), which are used for controlling basic input/output operations of the CPU 1.

According to the current embodiment, melody data, chord progression data and data representative of a plurality of accompaniment patterns are prestored as song data for a total of ten music pieces, and the song data comprise "song 1"–"song 10" corresponding to the ten music pieces. Here, let it be assumed that these song data have been supplied, along with performance-information-making controlling programs, from the floppy disk (FD), CD-ROM or magneto optical disk (MO) of the external storage device 11 and then prestored in the hard disk (HD). The CPU 1 stores the performance-information making controlling programs from the hard disk into the RAM 3, so as to control performance information making operations on the basis of the programs thus stored in the RAM 3 as will be later described in detail.

Figure 2:
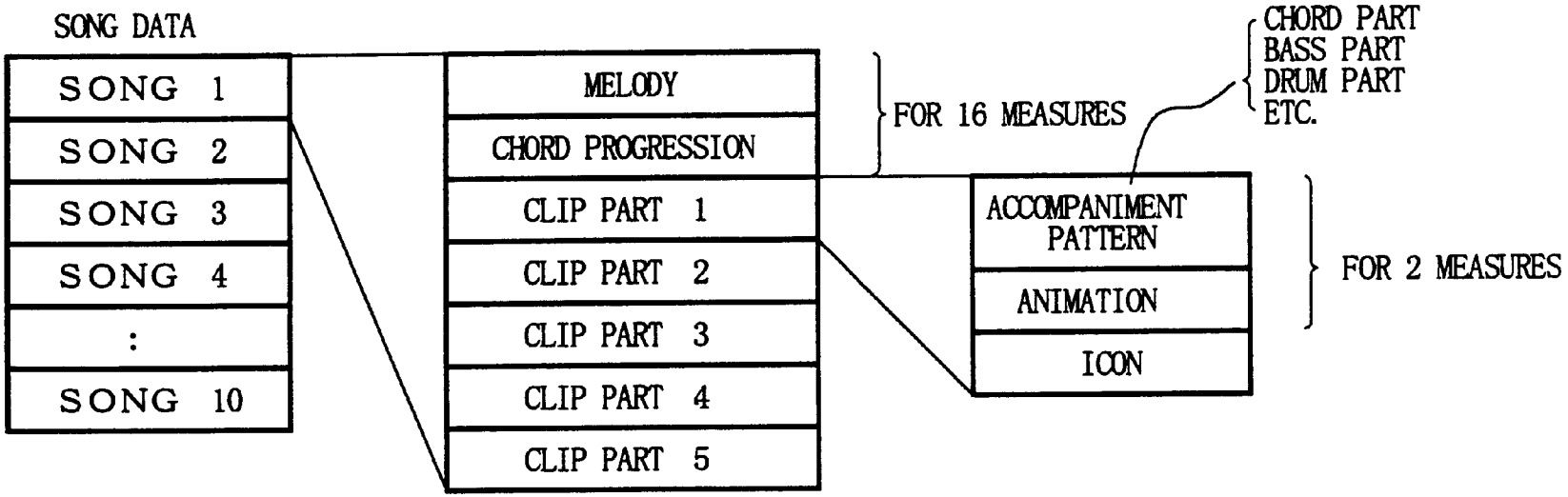
FIG. 2 is a diagram showing an exemplary storage format of song data in the first embodiment.

FIG. 2 is a diagram showing an exemplary storage format of the song data prestored in the hard disk in the current embodiment. As shown, each of the song data, "song 1" to "song 10", comprises a set of melody data for 16 measures, chord progression data for 16 measures and five different (kinds of) clip part data, "clip part 1"–"clip part 5". Each of the clip part data comprises a set of accompaniment pattern data for two measures, animation data for two measures and icon data. Namely, in the hard disk, there are prestored: ten different melodies; chord progressions suitable for the respective melodies, one chord progression per melody; and accompaniment patterns suitable for the respective melodies, five different accompaniment patterns per melody. Further, each of the accompaniment patterns comprises tone pitch information (note codes) in a predetermined musical key (such as C major) and tone generation timing information, and is converted in tone pitch in accordance with chords specified by the chord progression data when it is to be actually reproduced. The animation and icon data are used for visual presentation on the display device 8 during making of performance information, as will be later described.

Figures 3, 5:
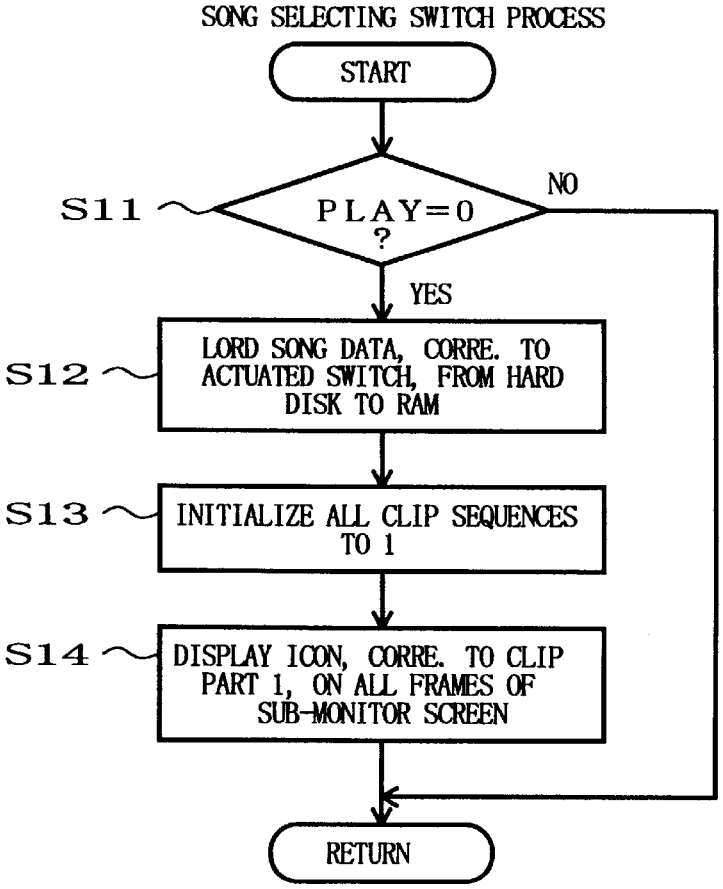
FIG. 3 is a diagram showing an exemplary storage format of clip sequence data in the first embodiment.
FIG. 5 is a flowchart of a song selecting switch process carried out by a CPU in the first embodiment.

When one of the song data is selected during making of performance information, clip part data for 16 measures corresponding to the length of the melody (i.e., eight clip part data) are selected at random for the selected song data. More specifically, as illustrated in FIG. 3, every two measures from the start of the song (comprising 16 measures) to be reproduced is designated as a performance sequence ("sequence 1"–"sequence 8"), and, for each of these sequences, one of the five clip parts, "clip part 1"–"clip part 5", is selected at random to allocate the clip part data to the sequence. Then, for each of the sequences, the selected clip data number (one of numbers 1–5) is stored as clip sequence data in association with that sequence.

Figure 4:
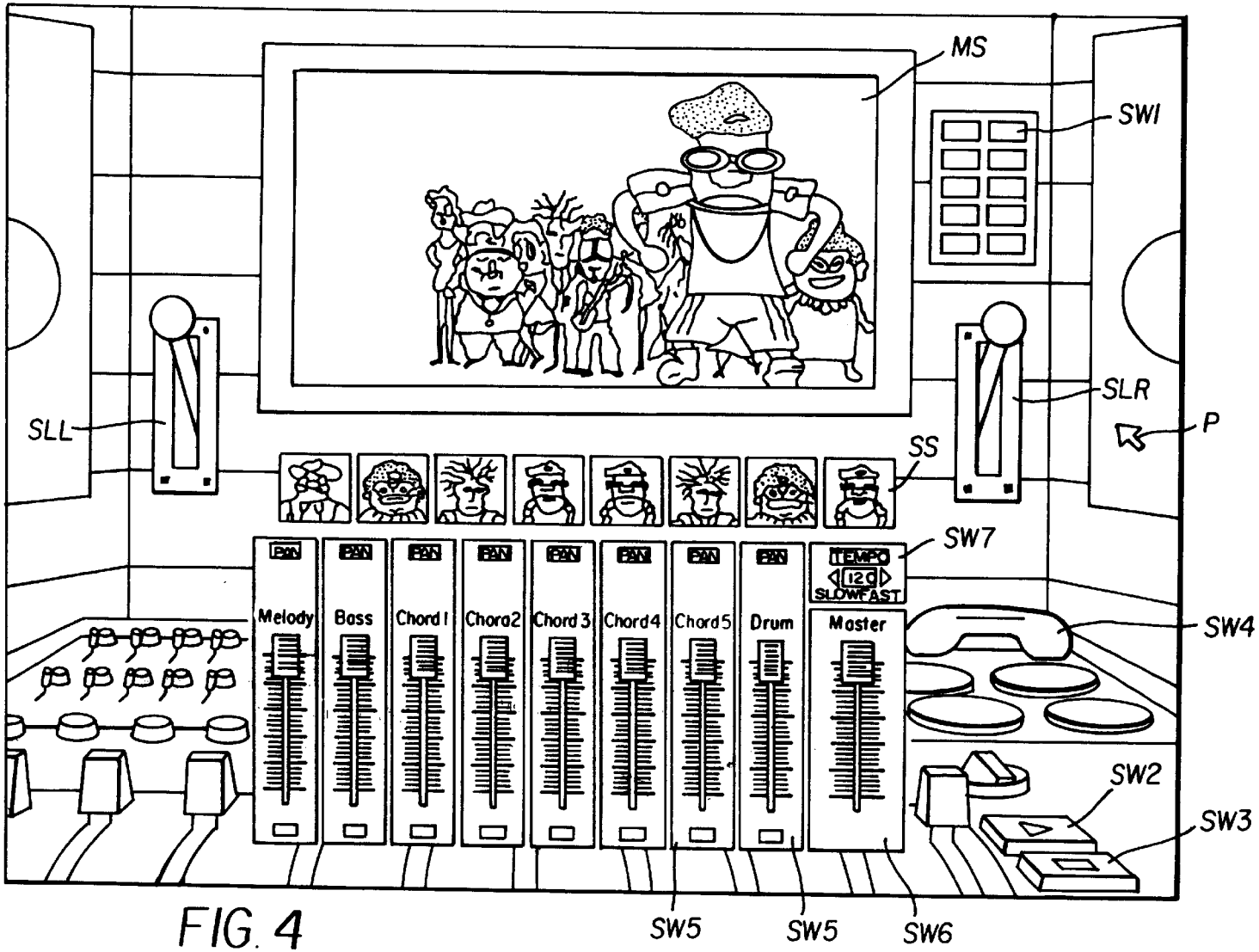
FIG. 4 is a diagram illustrating a picture displayed during making of performance information.

FIG. 4 is a diagram illustrating a picture displayed during making of performance information, on which are shown a main screen section MS for presenting an animation corresponding to a reproduced song and a sub-monitor screen section SS for presenting icons corresponding to a selected clip part.

On another section, there are also displayed various switches that can be operated through the mouse pointer P movable in response to user's operation of the mouse 6 and user's clicking operation on the mouse 6. More specifically, the displayed switches includes: song selecting switches SW1 for selecting a desired song from among the ten different song data; left and right clip selecting levers SLL, SLR for instructing a start of clip part selection (accompaniment pattern selection); a play switch SW2 for instructing a start of reproduction of a song; a stop switch SW3 for instructing a stop of reproduction of the song; a saving switch SW4 for saving data of a song made; a part setting switch SW5 for setting a tone volume for each track (performance part) of the song; a main setting switch SW6 for setting a main tone volume of the song; and a tempo switch SW7 for setting a reproduction tempo of the song.

Typically, user's operation on the screen takes place in the following manner. First, when any one of the song selecting switches SW1 corresponding to a desired song number is operated to select a song, predetermined icons corresponding to the selected song are displayed on eight frames of the sub-monitor screen SS. Then, when the left clip selecting lever SLL is actuated, the icons in the left four frames sequentially change at random until they stop changing to be fixedly displayed upon lapse of a predetermined time period. This way, eight measures (i.e., four accompaniment patterns) in the former half of the song are determined randomly. Similarly, by the user actuating the right clip selecting lever SLR, the icons in the right four frames sequentially change at random until they stop changing to be fixedly displayed upon lapse of a predetermined time period, so that eight measures (i.e., four accompaniment patterns) in the latter half of the song are determined randomly.

Then, once the play switch SW2 is actuated by the user, the melody of the selected song is reproduced along with the selectively determined accompaniment patterns, during which time an animation corresponding to the selected song and accompaniment patterns is displayed on the main screen MS. To stop the reproduction, the stop switch SW3 is actuated.

To change either the former-half accompaniment patterns or the latter-half accompaniment patterns, it is only necessary for the user to operate one of the left and right clip selecting levers SLL, SLR. Such operation of the clip selecting lever provides desired accompaniment patterns, which can be saved, for example, in the floppy disk of the external storage device 11 by actuating the saving switch SW4.

FIGS. 5 to 10 are flowcharts of performance-information-making controlling programs carried out by the CPU 1 of FIG. 1, and a description will be made hereinafter about detailed control operations of the CPU 1 on the basis of these flowcharts. Reproduction flag PLAY is allocated in the RAM 3 and this reproduction flag PLAY is set to "1" when reproduction of a song is under way and set to "0" when reproduction of a song is not under way.

Song selecting switch process of FIG. 5 is triggered by user's operation of any one of the song selecting switches SW1. At first step Sll, a determination is made as to whether the reproduction flag PLAY is at the value of "0" or not. If the reproduction flag PLAY is not at "0", this means that reproduction of a song is under way, so that the CPU 1 returns to a preceding routine without executing any other operations. Namely, user's selection of a song is made valid only when no other song is being reproduced; that is, any new song can not be selected even when the user actuates any one of the song selecting switches SW1 during reproduction of another song. If, on the other hand, the reproduction flag PLAY is at "0", this means that reproduction of a song is not under way, so that the CPU 1 proceeds to next step S12 to load the song data, corresponding to the operated switch, from the hard disk of the external storage device 11 to the RAM 3. After step S12, the CPU 1 goes to step S13, where the clip sequences are all set to an initial value of 1 (i.e., clip part number "1"). After that, the CPU 1 proceeds to step S14 in order to display, on the sub-monitor screen SS, the icons corresponding to clip part 1 in the selected song data and then returns to the preceding routine.

Figure 6:
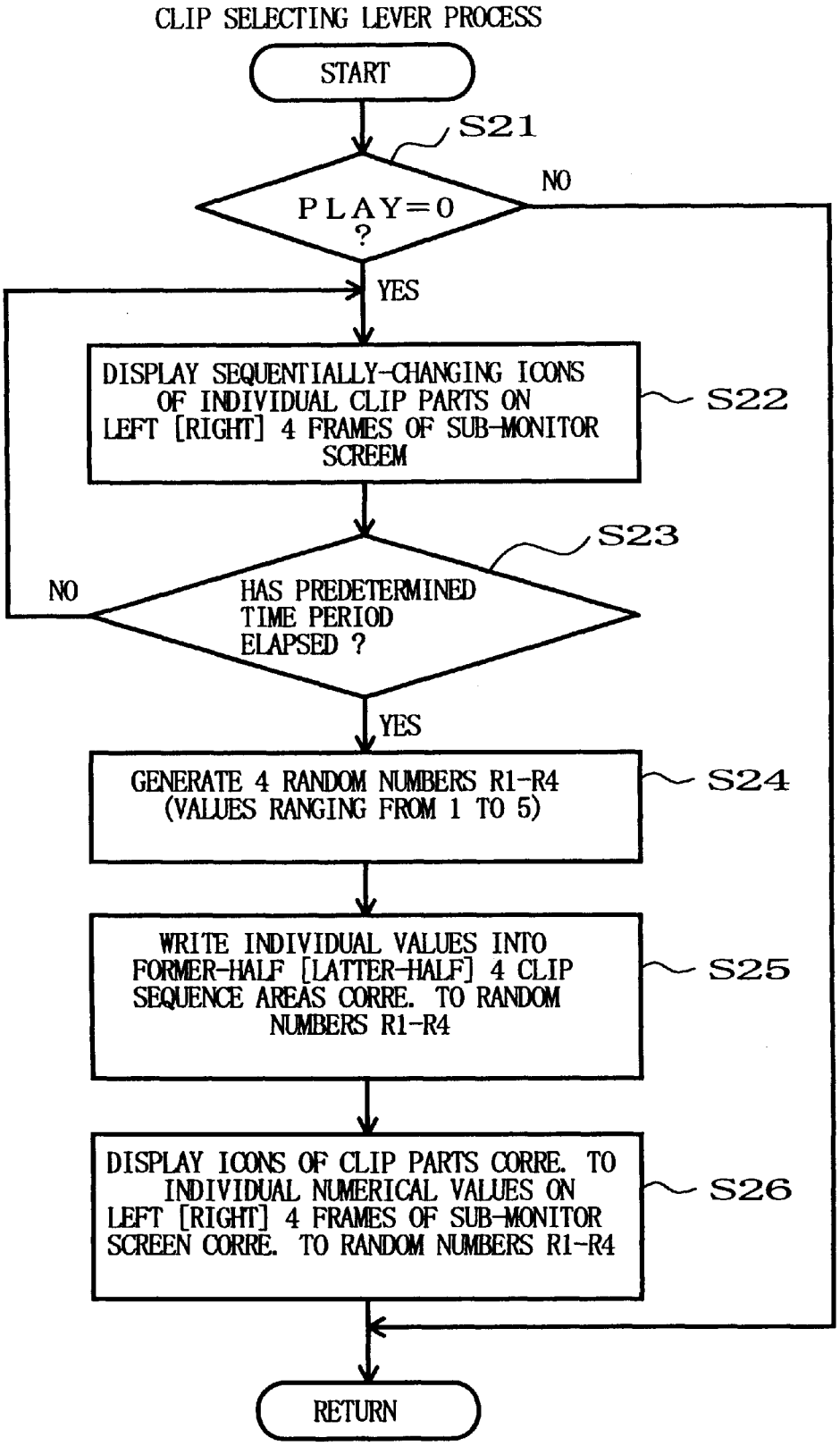
FIG. 6 is a flowchart of a clip selecting lever process carried out by the CPU in the first embodiment.

FIG. 6 is a flowchart of a clip selecting lever process that is triggered by user's operation of the left or right clip selecting lever SLL or SLR. In the flowchart, both the processes triggered by the left and right clip selecting lever SLL and SLR are shown together, for simplicity of illustration, because they are different from each other only in that the process triggered by the left clip selecting lever SLL is performed on the left four frames (i.e., former half of a song) while the process triggered by the right clip selecting lever SLR is performed on the right four frames (i.e., latter half of the song). Specifically, in the flowchart, actions taken in response to operation of the left clip selecting lever SLR are depicted mainly, with actions responsive to operation of the right clip selecting lever SLR depicted in brackets.

First, at step S21, a determination is made as to whether the reproduction flag PLAY is at "0" or not. If the reproduction flag PLAY is not at "0", this means that reproduction of a song is under way, so that the CPU 1 returns to a preceding routine without executing any other operations. If, on the other hand, the reproduction flag PLAY is at "0", this means that reproduction of a song is not under way, so that the CPU 1 proceeds to next step S22. Namely, selection of clipper parts by actuation of the clip selecting lever SLL or SLR is made valid only when no song is being reproduced. At step S22, icons corresponding to the clip parts are displayed on the left [or right] four frames of the sub-monitor screen SS while being sequentially changed. At next step S23, it is determined whether a predetermined time period (i.e., 1–2 seconds) has elapsed or not. If the predetermined time period has not yet elapsed, the CPU 1 reverts to step S22, while if the predetermined time period has elapsed, the CPU 1 proceeds to next step S24.

Four random numbers R1–R4 (numerical values ranging from 1 to 5) are generated at step S24, and at step S25 these values are written, as clip part numbers, into the former-half [latter-half] four clip sequence areas corresponding to the random numbers R1–R4. At next step S26, clipper part icons corresponding to the numerical values are displayed on the left [right] four frames of the sub-monitor screen SS which correspond to the random numbers R1–R4, and then the CPU 1 returns to the preceding routine.

Thus, in response to the user's operation of the left or right clip selecting lever SLL or SLR, clipper parts in the former or latter half of the song are randomly selected from among the five different clipper parts. Accordingly, accompaniment data are selected randomly and stored as clip sequence data.

Figure 7:
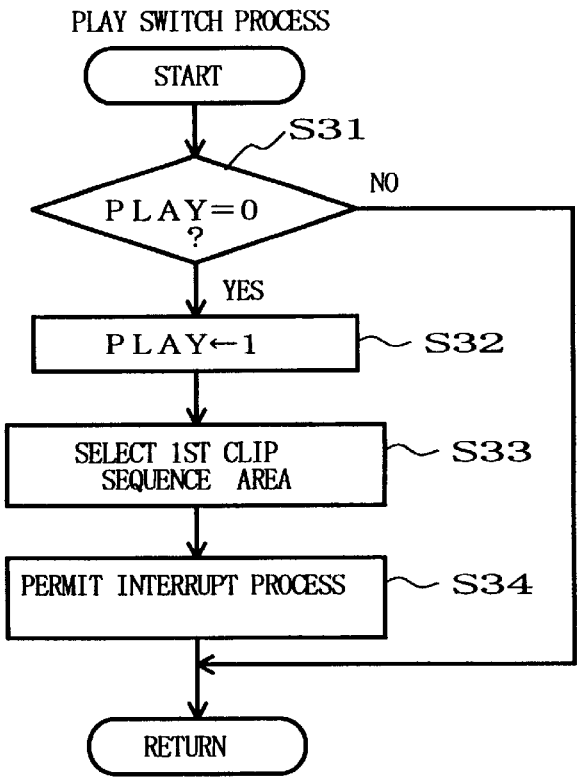
FIG. 7 is a flowchart of a play switch process carried out by the CPU in the first embodiment.

Play switch process of FIG. 7 is triggered by user's operation of the play switch SW2. At first step S31, a determination is made as to whether the reproduction flag PLAY is at "0" or not. If the reproduction flag PLAY is not at "0", this means that reproduction of a song is under way, so that the CPU 1 returns to a preceding routine without executing any other operations. If, on the other hand, the reproduction flag PLAY is at "0", this means that the play switch SW2 has been actuated when reproduction of a song is not under way, so that the CPU 1 sets the reproduction flag PLAY to "1" at step S32 and then proceeds to next step S33. At step S33, the first clip part area of the clip sequence data is selected as an initial state for reproduction of a song. A next step S34, the CPU 1 gives permission to carry out an interrupt process for song reproduction and then returns to the preceding routine.

Thus, in response to the user's operation of the play switch SW2 when no song is being reproduced, the CPU 1 behaves to reject user's subsequent operation of any other switch than the stop switch SW3 and permit a song reproduction process (interrupt process) as will be later described.

Figure 8:
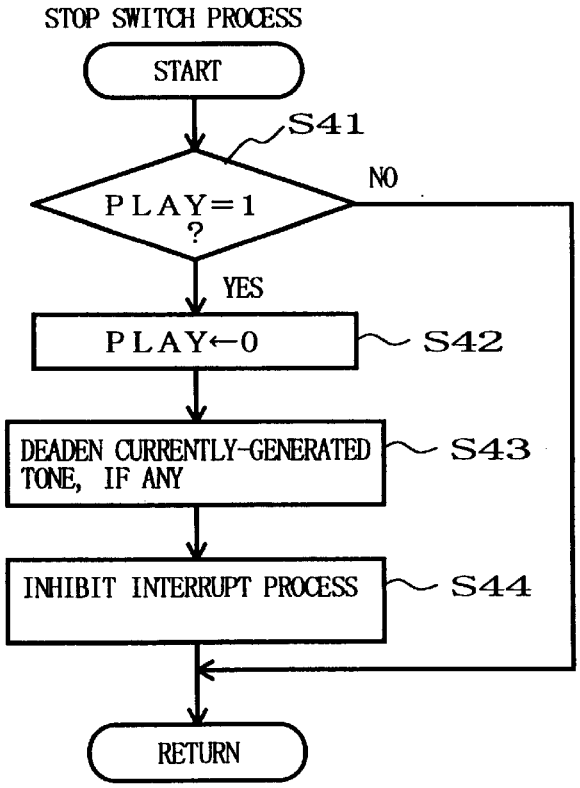
FIG. 8 is a flowchart of a stop switch process carried out by the CPU in the first embodiment.

Stop switch process of FIG. 8 is triggered by user's operation of the stop switch SW3. At first step S41, a determination is made as to whether the reproduction flag PLAY is at "1" or not. If the reproduction flag PLAY is not at "1", this means that the stop switch SW3 has been actuated when reproduction of a song is not under way, so that the CPU "1" returns to a preceding routine without executing any other operations. If, on the other hand, the reproduction flag PLAY is at "1", this means that the stop switch SW3 has been actuated when reproduction of a song is under way, so that the CPU 1 sets the reproduction flag PLAY to "0" at step S42 and then proceeds to step S43. If any tone is being generated, this tone is deadened or muted at step S43. Then, the CPU 1 returns to the preceding routine after having inhibited subsequent interruption for the song reproduction process at step S44.

Thus, in response to the user's operation of the stop switch SW3 when a song is being reproduced, the song reproduction is stopped (subsequent interruption for the song reproduction process is inhibited) and thereafter the CPU 1 functions to accept user's operation of any of the other switches.

Figure 9:
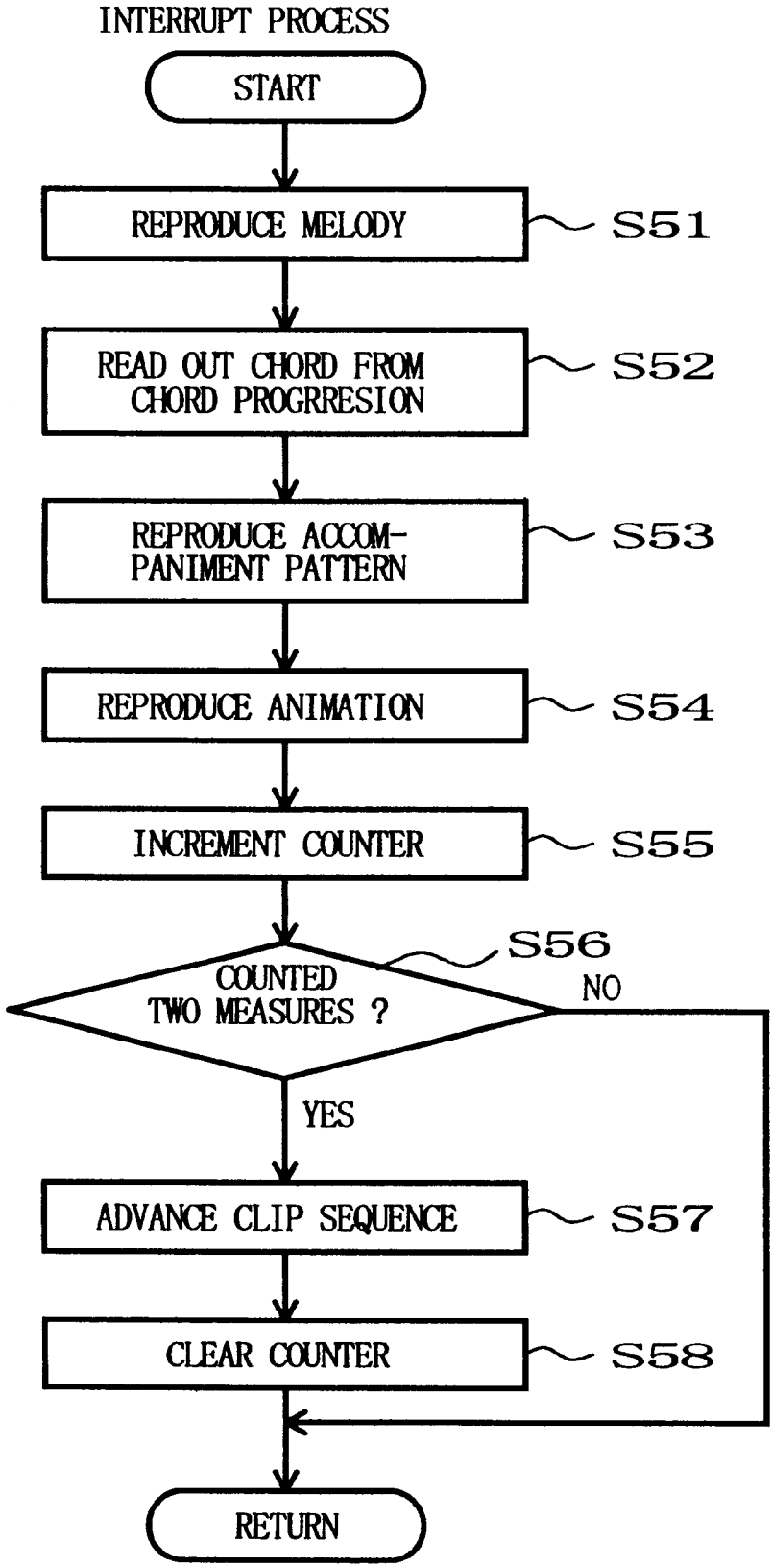
FIG. 9 is a flowchart of an interrupt process carried out by the CPU in the first embodiment.

FIG. 9 is a flowchart of the interrupt process for song reproduction, which is triggered by each software-based interrupt signal generated at timing corresponding to a currently-set tempo. This interrupt process is carried out only when the permission to the interruption is given in response to the user's operation of the play switch SW2.

In this interrupt process, there are employed a register for indicating a currently-reproduced sequence (i.e., one of sequences 1–8) of the clip sequence data and a counter for counting measures corresponding to the individual sequences. These register and counter are allocated in the RAM 3, and various data on the melody, chord progression, accompaniment pattern and animation are read out, at timing determined by current values of the register and counter, so as to execute generation of tones and reproduction of animations.

The CPU 1 reproduces melody data corresponding to current timing of a song in the currently-selected song data at step S51, and reads out a chord corresponding to current timing from the chord progression of the song data at step S52. Then, the CPU 1 proceeds to step S53, where accompaniment data are read out from the clip part designated by current clop sequence data and individual note codes in the accompaniment data are modified (pitch-converted) on the basis of the current chord to thereby actually reproduce an accompaniment pattern. At next step S54, animation data are read out from the same clip part so as to reproduce an animation.

After that, the above-mentioned counter is incremented by one at step S55, and a determination is made at next step S56 as to whether or not two measures have already been counted by the counter. If two measures have not been counted as determined at step S56, the CPU 1 returns to a preceding routine; however, if two measures have been counted, the CPU 1 updates the register to advance the clip sequence at step S57. Then, the CPU 1 returns to the preceding routine after having cleared the counter at step S58. Once the clip sequence has advanced to "sequence 8" as a result of the operation of step S57, the CPU 1 sets the clip sequence back to "sequence 1". Thus, the 16-measure song will be repetitively reproduced until the stop switch SW3 is actuated.

In the above-mentioned manner, accompaniment patterns, corresponding to randomly selected clipper parts in sequences 1–8 of the clip sequence data, are sequentially reproduced along with the melody. Simultaneously, animations corresponding to the accompaniment patterns are also reproduced.

Figure 10:
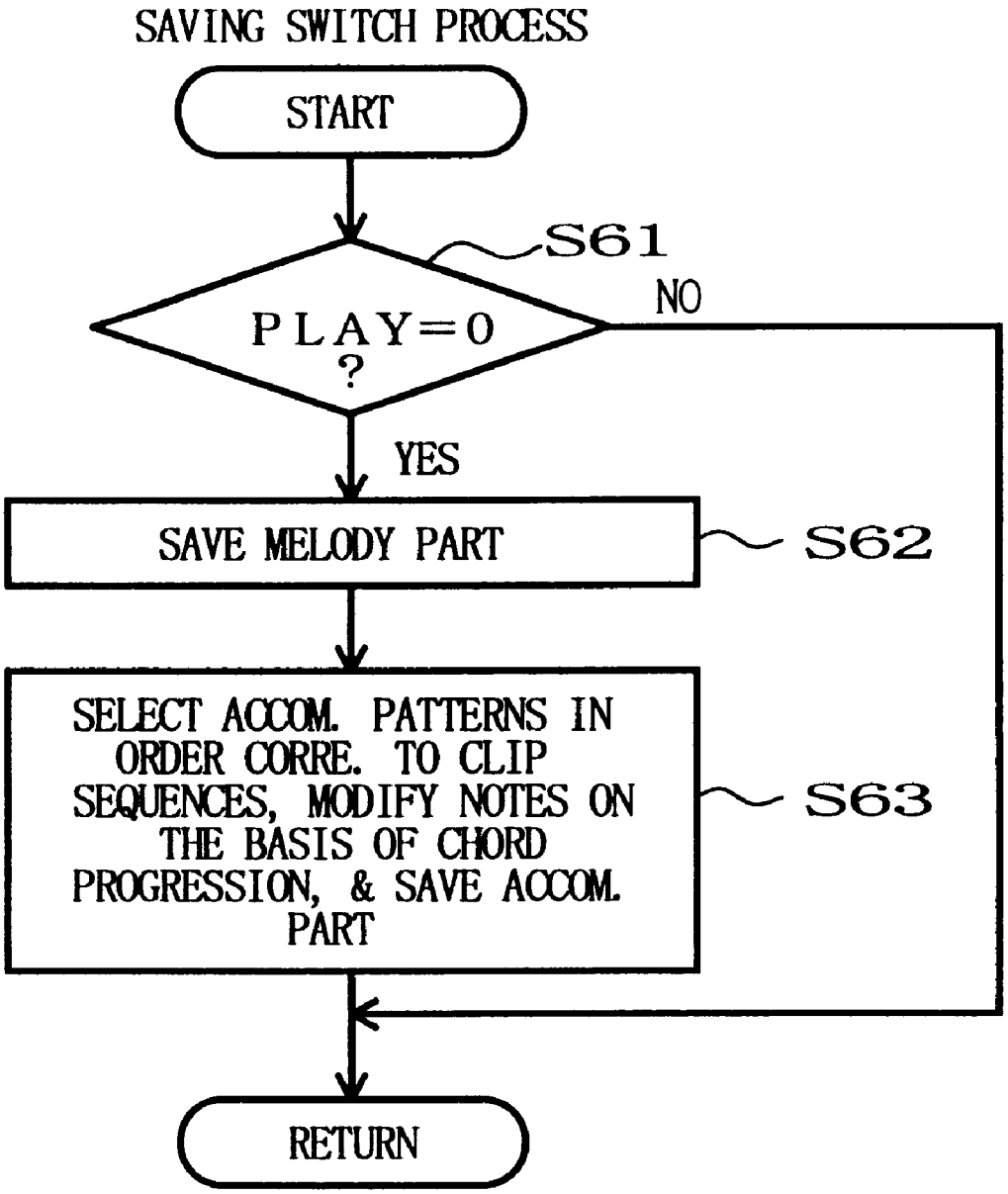
FIG. 10 is a flowchart of a saving switch process carried out by the CPU in the first embodiment.

Saving switch process of FIG. 10 is triggered by user's operation of the saving switch SW4. At first step S61, a determination is made as to whether the reproduction flag PLAY is at "0" or not. If the reproduction flag PLAY is not at "0", this means that the saving switch SW4 has been actuated when reproduction of a song is under way, so that the CPU 1 returns to a preceding routine without executing any other operations. If, on the other hand, the reproduction flag PLAY is at "0", this means that the saving switch SW4 has been actuated when reproduction of a song is not under way, so that the CPU 1 proceeds to next step S62. At step S62, the melody (melody part) data in currently-selected song data are saved. At next step S63, accompaniment patterns are selectively read out sequentially in such order corresponding to the clip sequences, and individual note codes in the accompaniment patterns are modified on the basis of the chord progression so as to be saved as an accompaniment part. Note that the melody and accompaniment patterns are saved in the standard MIDI file format well known in the art.

As described above, the accompaniment patterns are saved as note codes at step S63, so that the saved data can be reproduced by any other equipment. However, information representative of the clip sequence date and song data itself may be saved in the case where the data are handled in a device similar to that of the present embodiment.

Figure 11:
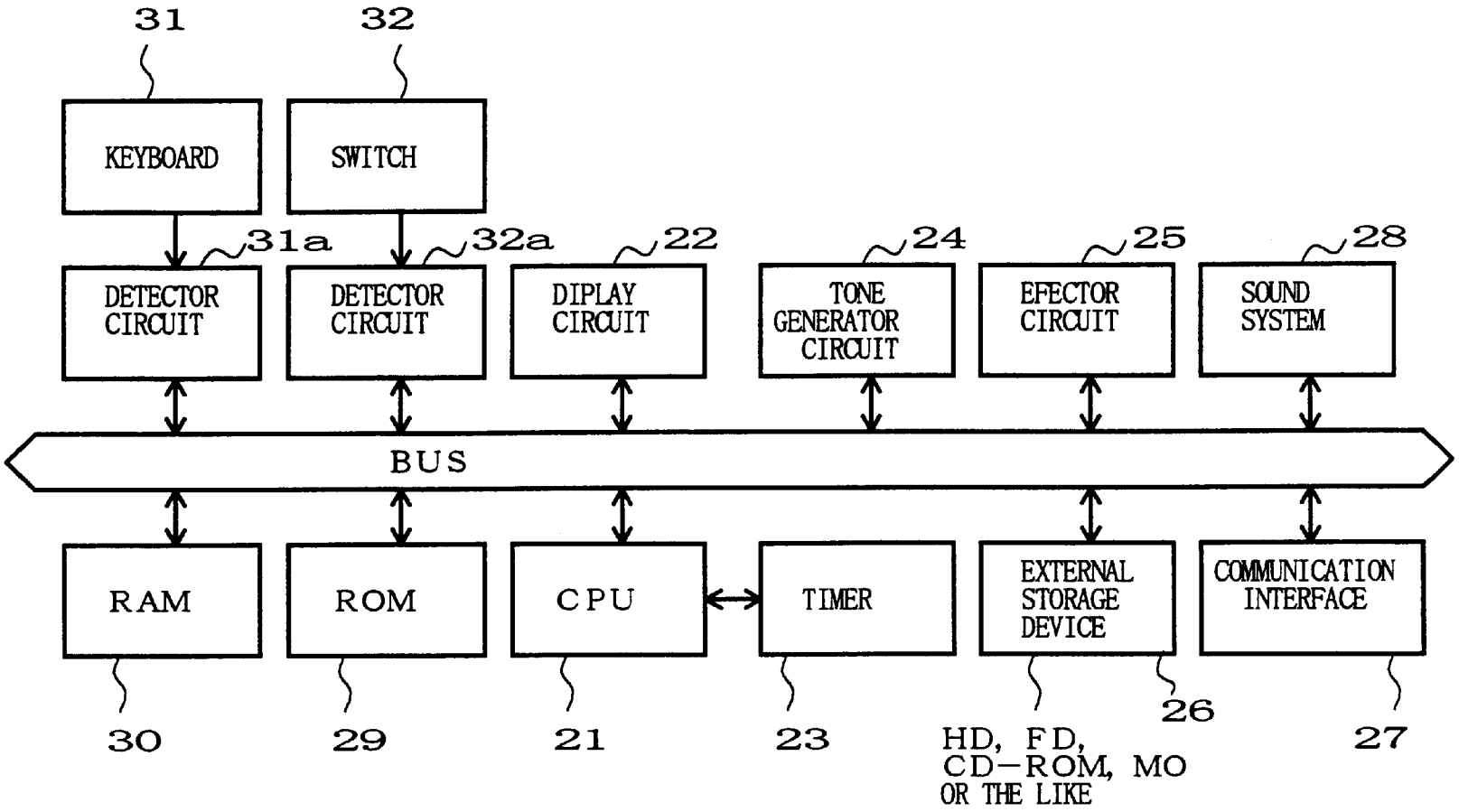
FIG. 11 is a block diagram of a performance information making device according to a second embodiment of the present invention.

The first embodiment, which has been described as implemented by a personal computer and software, may be applied to an electronic musical instrument. FIG. 11 is a block diagram illustrating a second embodiment of the present invention as applied to an electronic musical instrument. In FIG. 11, elements not shown in the first embodiment of FIG. 1 and functionally differing from the counterparts of the first embodiment are a keyboard 31, a switch 32, detector circuits 31*a*, a timer 23, a tone generator circuit 24 and an effector circuit 25.

Whereas the interrupt process for song reproduction is triggered by a software-based interrupt signal in the first embodiment, the second embodiment is designed to trigger the interrupt process via the timer 23 that is provided in the electronic musical instrument to execute an automatic performance or automatic accompaniment. Namely, the timer 23 generates interrupt signals at timing corresponding to a tempo set by the CPU 21, and in response to each of the generated interrupt signals, the CPU 21 carries out an interrupt process, similar to that of the first embodiment, so as to execute reproduction of a selected song.

Display circuit 22 comprises a liquid crystal display (LCD) panel to visually display various information of the electronic musical instrument in animations and icons as in the first embodiment. In the second embodiment, data input/output operation is performed by the user via a switch 42, in stead of the mouse in the first embodiment, which is operated to move a cursor on the screen. A dedicated screen switch may be provided, or alternatively a particular existing switch may be used also as the screen switch.

Tone signals are generated by the tone generator circuit 24 on the basis of tone control data supplied from the CPU 21. The effector circuit 25 imparts particular effects to the generated tone signals, which are then audibly reproduced via a sound system 28. Namely, the tone generator circuit 24 and effector circuit 25 functionally correspond to the sound board 9 of the first embodiment.

External storage device 26 and communication interface 27 are similar to the counterparts in the first embodiment. For example, song data are supplied, along with performance-information-making controlling programs, from a floppy disk, CD-ROM or magneto optical disk (MO) of the external storage device 26 and then prestored in a hard disk. The CPU 21 stores the performance-information-making controlling programs from the hard disk into the RAM 3 and controls performance information making operations on the basis of the programs thus stored in the RAM 3. Operations performed in the second embodiment on the basis of the-performance-information making controlling programs are similar to those of FIGS. 5 to 10 described earlier in relation to the first embodiment.

In a ROM 29, there may be prestored the performance information making control programs and song data as well as a dedicated control program for the electronic musical instrument.

Note that the present invention may be applied to any other forms of musical instrument than the keyboard instrument as in the second embodiment, such as stringed instruments, wind instruments and percussion instruments. Further, the present invention may be applied to electronic musical instruments where the tone generator, sequencer, effector, etc. are separate components interconnected via a MIDI or communication means such as a communication network, rather than those which incorporate therein a tone generator and automatic performance function.

The preferred embodiments of the present invention have been described above in relation to the case where the song data has a length of 16 measures—specifically, both the melody and chord progression have a length of 16 measures, and the accompaniment pattern has a length of (two-measure clip part)×(eight clip sequences)—; however, the present invention is not so limited. Further, whereas the preferred embodiments have been described in relation to the case where five clip parts are provided in advance for each song, the number of clip parts per song may be less or more than five.

Further, whereas the preferred embodiments have been described in relation to the case where each clip part comprises a set of an accompaniment pattern and animation, the clip part may comprises only an accompaniment pattern. Also, one animation may be provided for each song rather than for each clip part; in this case, some parameters of the animation (e.g., parameters relating to the hair style and dress of a human figure, background or the like) may be varied each time one clip part changes to another. Such parameter variations alone, however, will make an impression that the animation changes considerably depending on the clop part.

Further, if the accompaniment pattern is only for a drum part, then the chord progression data is of course unnecessary; namely, the accompaniment pattern may comprise data only of a melody and drum part.

Furthermore, whereas the preferred embodiments have been described above as allowing clip sequences in the former-half and latter-half of a song to be randomly selected by operation of two clip selecting levers, clip sequences in an entire music piece may be selected at random by only one clip selecting lever. Alternatively, three or more clip selecting levers may be provided and a music piece may be divided into three or more sections accordingly. The randomly selected clip sequences may be changed partially through a user's manual selection.

Figure 12:
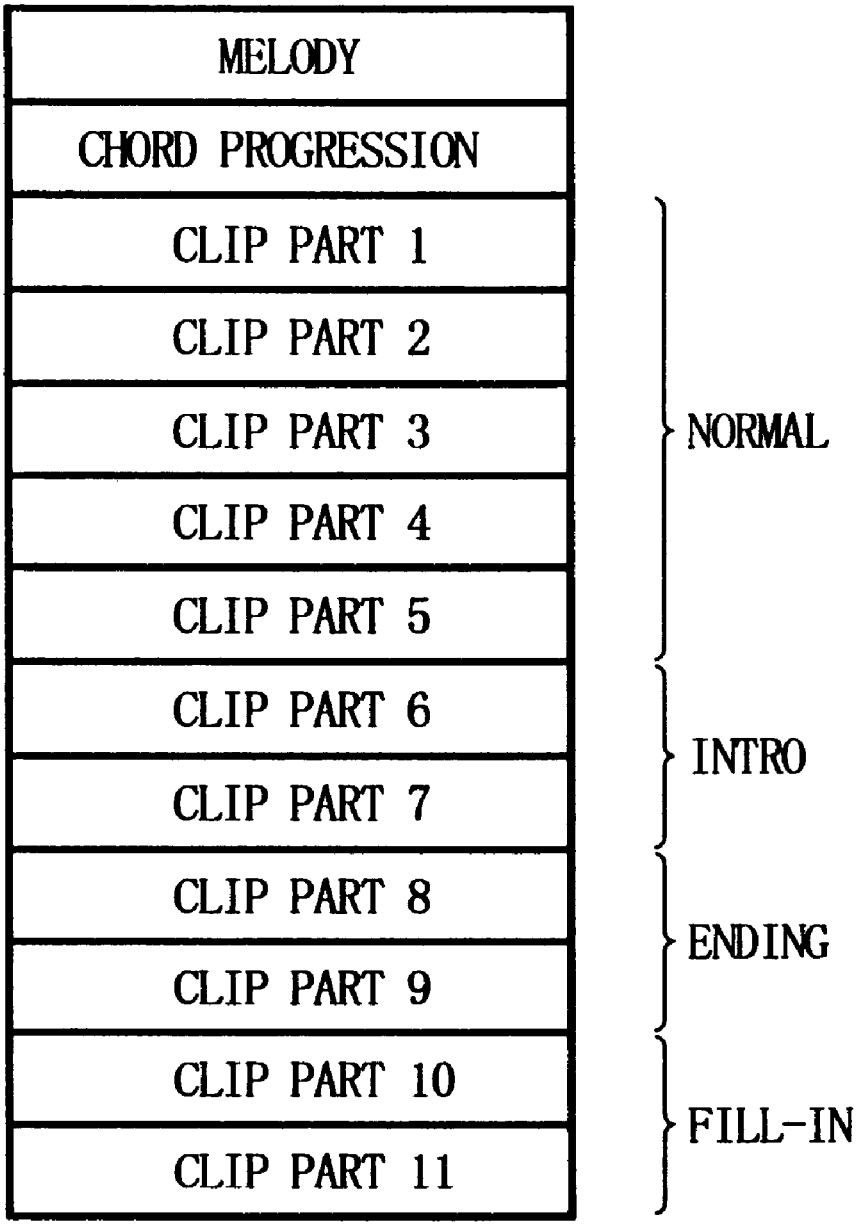
FIG. 12 is a diagram showing another example of the data storage format in a song data memory.

In addition, there may be additionally provided accompaniment patterns suitable for the introductory and ending sections of a music piece so that particular patterns can be selected from among the intro and ending accompaniment patterns for the beginning and ending sections of the music piece, as shown in FIG. 12. Also, there may be provided accompaniment patterns suitable for a fill-in performance and a fill-in instructing switch so that a fill-in pattern can be inserted at optional timing in response to user's operation of the switch.

Moreover, whereas the preferred embodiments have been described above in relation to the case where the accompaniment pattern read out with reference to clip sequence data is sequentially changed during an accompaniment performance, accompaniment patterns may be linked together with reference to clip sequence data prior to reproduction of a song so that the song can be reproduced by just sequentially reading out the previously-linked accompaniment patterns.

Furthermore, although the preferred embodiments have been described above in relation to the case where one clip part can not be changed to another during reproduction, the present invention may be arranged to accept a shift to another clip part. In this case, such a shift to a new clip part may be executed upon arrival at a predetermined point (such as a measure line or end of two measures) of the current clip part.

Moreover, whereas the preferred embodiments have been described above in relation to the case where performance-information-making controlling programs and song data are supplied from the external storage device 11, 26 or prewritten in the ROM 29, such programs and song data may be downloaded using the communication interface 10, 27. In this case, the communication interface 10, 27 is connected to a communication network, such as a LAN, Internet or telephone line network, by way of which the performance-information-making controlling programs and song data are supplied. The supplied programs and song data are then recorded on the hard disk, for completion of the downloading.

Data of the melody and accompaniment part may be recorded in any of the known formats, such as: the "event plus relative time" format where the occurrence time of each performance event is expressed in an elapsed time (i.e., timing represented by the number of clock pulses) from a preceding performance event; the "event plus absolute time" format where the occurrence time of each performance event is expressed in an absolute time within a music piece or within a measure; the "pitch (rest) plus note length" format where each performance data is expressed in a note pitch and note length or rest and rest length; and the "solid writing" format where a storage location is provided in a memory for each minimum resolution of a performance (for each clock pulse in the above-described preferred embodiments) and each performance event is stored in one of the memory locations corresponding to its occurrence time.

The song reproduction tempo may be varied in any of various ways, such as by changing the frequency of tempo clock pulses (interrupt signals), changing the value of timing data in accordance with the tempo while maintaining the tempo clock frequency, or changing a value (e.g., subtracting quantity) with which to count the timing data in a single process.

Moreover, the accompaniment pattern may comprise data of a plurality of channels, and the data of each channel may be separated for each track.

In addition, the tone generation in the tone generator or sound board may be by any of the known methods, such as the waveform memory method, FM method, physical model method, harmonic synthesis method, formant synthesis method, and analog synthesizer method based on VCO (Voltage Controlled Oscillator), VCF (Voltage Controlled Filter) and VCA (Voltage Controlled Amplifier). The tone generator circuit may be implemented by a combination of a DSP (Digital Signal Processor) and microprograms or by a combination of a CPU and software programs, rather than by dedicated hardware. Further, a plurality of tone generating channels may be provided by using a single tone generator circuit on a time-divisional basis, or each tone generating channel may be provided by one tone generator circuit.

In summary, the performance information making device and method and the performance-information-making controlling programs having so far been described are characterized in that accompaniment patterns corresponding to a plurality of melody performance sections of a music piece are randomly selected from among a plurality of predetermined accompaniment patterns suitable for the music piece and the randomly selected accompaniment patterns are reproduced as performance information along with the melody. Such an arrangement allows the reproduced accompaniment information to become suitable for the melody even where the nature of the melody and accompaniment patterns are not taken into consideration. As a result, the present invention can generate various variations of accompaniment patterns well suitable for a melody and thereby allows even unexperienced users or beginners to fully enjoy composing a music piece.

What is claimed is:

1. A performance information making device comprising:

a storage device having prestored therein information representative of a plurality of accompaniment patterns suitable for a given music piece; and a pattern selecting device that, for each of predetermined performance sections of a melody of the given music piece, randomly selects a particular accompaniment pattern from among the plurality of accompaniment patterns suitable for the given music piece, so that accompaniment performance information for the given music piece is provided by combining the accompaniment patterns randomly selected for individual ones of the performance sections.

2. A performance information making device as recited in claim 1 wherein said pattern selecting device includes:

an instructing device that instructs that a random selection of the accompaniment pattern should be made for a predetermined performance range covering a predetermined number of the performance sections; and a selection controlling device that, when said instructing device instructs that the random selection should be made, randomly selects a particular accompaniment pattern for each of the predetermined number of performance sections within the predetermined performance range.

3. A performance information making device as recited in claim 1 wherein said storage device also has prestored therein melody information of the given music piece, and which further comprises a reproducing device that reproductively performs a melody and accompaniment of the given music piece on the basis of the melody information prestored in said storage device and accompaniment performance information comprising a combination of the accompaniment patterns selected by said pattern selecting device.

4. A performance information making device as recited in claim 3 which further comprises:

a pattern change instructing device that instructs an accompaniment pattern change during a reproductive performance by said reproducing device; and a controlling device that, when a currently-reproduced accompaniment pattern is to be changed to another accompaniment pattern in response to an instruction by said pattern change instructing device, performs control such that a change to the other accompaniment pattern takes place at a predetermined position of the currently-reproduced accompaniment pattern.

5. A performance information making device as recited in claim 1 wherein said storage device has prestored therein, for each of time-varying performance phases of the given music piece, information representative of a plurality of accompaniment patterns suitable for the performance phase, and wherein, for each of the performance sections, said pattern selecting device randomly selects a particular accompaniment pattern from among the plurality of accompaniment patterns suitable for the performance phase to which the performance section belongs.

6. A performance information making device as recited in claim 1 which further comprises a device that displays, in symbolized form, contents of the accompaniment pattern randomly selected for each of the performance sections.

7. A performance information making device as recited in claim 1 wherein said pattern selecting device includes an instructing device that instructs, whenever necessary, that a random selection of the accompaniment pattern should be made.

8. A performance information making device comprising:

storage means for prestoring therein information representative of a plurality of accompaniment patterns suitable for a given music piece; and pattern selecting means for, for each of predetermined performance sections of a melody of the given music piece, randomly selecting a particular accompaniment pattern from among the plurality of accompaniment patterns suitable for the given music piece, so that accompaniment performance information for the given music piece is provided by combining the accompaniment patterns randomly selected for individual ones of the performance sections.

9. A performance information making method comprising the steps of:

prestoring information representative of a plurality of accompaniment patterns suitable for a given music piece; and for each of predetermined performance sections of a melody of the given music piece, randomly selecting a particular accompaniment pattern from among the plurality of accompaniment patterns suitable for the given music piece, so that accompaniment performance information for the music piece is provided by combining the accompaniment patterns randomly selected for individual ones of the performance sections.

10. A performance information making method as recited in claim 9 which further comprises the steps of:

prestoring melody information of the given music piece; and reproductively performing a melody and accompaniment of the given music piece on the basis of the prestored melody information and accompaniment performance information comprising a combination of the accompaniment patterns selected for the individual performance sections.

11. A machine-readable recording medium containing a control program executable by a computer, said control program comprising:

a program code mechanism that, for each of predetermined performance sections of a melody of a given music piece, randomly selects a particular accompaniment pattern from among a plurality of accompaniment patterns provided in advance and suitable for the given music piece; and a program code mechanism that generates a series of pieces of accompaniment performance information for the given music piece by combining the accompaniment patterns selected for individual ones of the performance sections.

12. A machine-readable recording medium containing, in a data storage area thereof, data representative of a melody of a given music piece and a plurality of accompaniment patterns suitable for the given music piece and also containing, in a program storage area thereof, a control program executable by a computer, said control program comprising:

a program code mechanism that, for each of predetermined performance sections of a melody of the given music piece, randomly selects a particular accompaniment pattern from among a plurality of accompaniment patterns provided in advance and suitable for the given music piece;

a program code mechanism that reads out, from said data storage area, the data representative of the accompaniment pattern randomly selected for each of the performance sections; and a program code mechanism that reads out the data representative of the melody from said data storage area; and a program code mechanism that reproductively performs the melody and accompaniment of the given music piece on the basis of the read-out data representative of the melody and accompaniment pattern.

* * * * *